US005365621A

United States Patent [19]

Blain

[11] Patent Number: 5,365,621

[45] Date of Patent: Nov. 22, 1994

[54] INVALID LIFT

[76] Inventor: Joseph E. Blain, 1218 McKercher Dr., Saskatoon, Saskatchewan, Canada, S7H 5L9

[21] Appl. No.: 946,758

[22] Filed: Sep. 17, 1992

[30] Foreign Application Priority Data

Sep. 24, 1991 [CA] Canada ..... 2052169

[51] Int. Cl.[5] ..... A61G 7/10

[52] U.S. Cl. ..... 5/81.1; 5/83.1; 5/86.1

[58] Field of Search ..... 5/81.1, 83.1, 86.1, 5/87.1, 85.1; 297/5, 6; 135/67

[56] References Cited

U.S. PATENT DOCUMENTS

| | | | |
|---|---|---|---|
| 2,792,052 | 5/1957 | Johannesen | 5/83.1 X |
| 2,914,110 | 11/1959 | Schulte | 5/81.1 X |
| 2,991,485 | 7/1961 | Schulte | 5/81.1 |
| 3,374,493 | 3/1968 | Herrara | 5/86 |
| 3,629,880 | 12/1971 | van Rhyn | 5/83.1 |
| 3,694,829 | 10/1972 | Bakker | 5/81.1 |
| 3,962,737 | 6/1976 | James | 5/86 |
| 4,188,966 | 2/1980 | Palmer et al. | 297/5 X |
| 4,211,426 | 7/1980 | Motloch | 297/5 X |
| 4,484,366 | 11/1984 | Koontz | 5/86 |
| 4,680,819 | 7/1987 | James | 5/86 |
| 4,682,377 | 7/1987 | Reich | 5/86 |
| 4,703,523 | 11/1987 | James | 5/83 |
| 4,920,590 | 5/1990 | Weiner | 5/86 |
| 5,117,516 | 6/1992 | Penner | 5/86.1 |

FOREIGN PATENT DOCUMENTS

| | | | |
|---|---|---|---|
| 728483 | 2/1966 | Canada | 155/14 |
| 943502 | 3/1974 | Canada | 214/48 |
| 976303 | 10/1975 | Canada | 5/26 |
| 1162158 | 2/1984 | Canada | 201/0.3 |
| 1176199 | 10/1984 | Canada | 201/0.1 |
| 1253447 | 5/1989 | Canada | 201/0.3 |
| 1262105 | 10/1989 | Canada | 201/0.3 |

OTHER PUBLICATIONS

Arjo Dextra Brochure.
Arjo Sara Brochure.
Arjo Maxilift Brochure.
Chiltern Wispa and Wispalong Brochure.

*Primary Examiner*—Michael F. Trettel
*Attorney, Agent, or Firm*—Robert M. Phipps

[57] ABSTRACT

This invention relates to a lift to assist persons to stand or walk, where they have insufficient strength in their legs. The lift includes a supporting frame having a front portion extending in front of the person and side portions on each side. There are wheels beneath the supporting frame to enable the lift to be manoeuvered. A lift arm is pivotally mounted on the supporting frame for movement in a vertical plane. A generally U-shaped support member is at the other end of the lift arm and comprises a pair of supporting bars adapted to fit under the armpits of a person. There are means for maintaining the U-shaped support substantially parallel to the ground as the lift arm is raised or lowered and hydraulic means for raising or lowering the lift arm.

6 Claims, 5 Drawing Sheets

INVALID LIFT

This invention relates to a lift to assist individuals to stand.

There is a need for a simple and practical lift to assist individuals to stand or to be transferred between a bed and a chair or toilet. There is also a need for a lift which will assist persons to stand and walk, even though they cannot safely use a conventional walker.

In accordance with this invention there is provided a lift to assist a person to stand comprising a supporting frame having a front portion extending in front of the person and side portions on each side of the person, wheels beneath the supporting frame to enable the lift to be manoeuvered, a rearwardly extending lift arm pivotally mounted at one end on the supporting frame for movement in a vertical plane, a generally U-shaped support member at the other end of the lift arm comprising a pair of supporting bars adapted to fit under the armpits of a person, means for maintaining the U-shaped support substantially parallel to the ground as the lift arm is raised or lowered and hydraulic means for raising or lowering the lift arm.

An important advantage of this invention is that unlike previous lifts which carry an invalid suspended in a harness, the lift of this invention supports the individual beneath his armpits. This provides more useful and dignified support, particularly for those who have some use of their legs. A harness, which may merely be a belt, can be used but this is just to give auxiliary support and safety. It does not provide the primary support. Another advantage is that the lift can function as a retraining device for persons who temporarily have difficulty in walking.

A lift in accordance with this invention is extremely versatile. It will assist a person to stand and/or be transferred to a sitting position in a chair, bed or bathroom. It can assist an individual to stand for periods of time, especially if the upper torso requires support at all times. If the individual has minimal use of his legs the unit can be used as a walker, even by persons who cannot use a conventional walker. It can be provided in an easily portable version.

In the drawings which illustrate the preferred embodiment of this invention:

Figure 1:
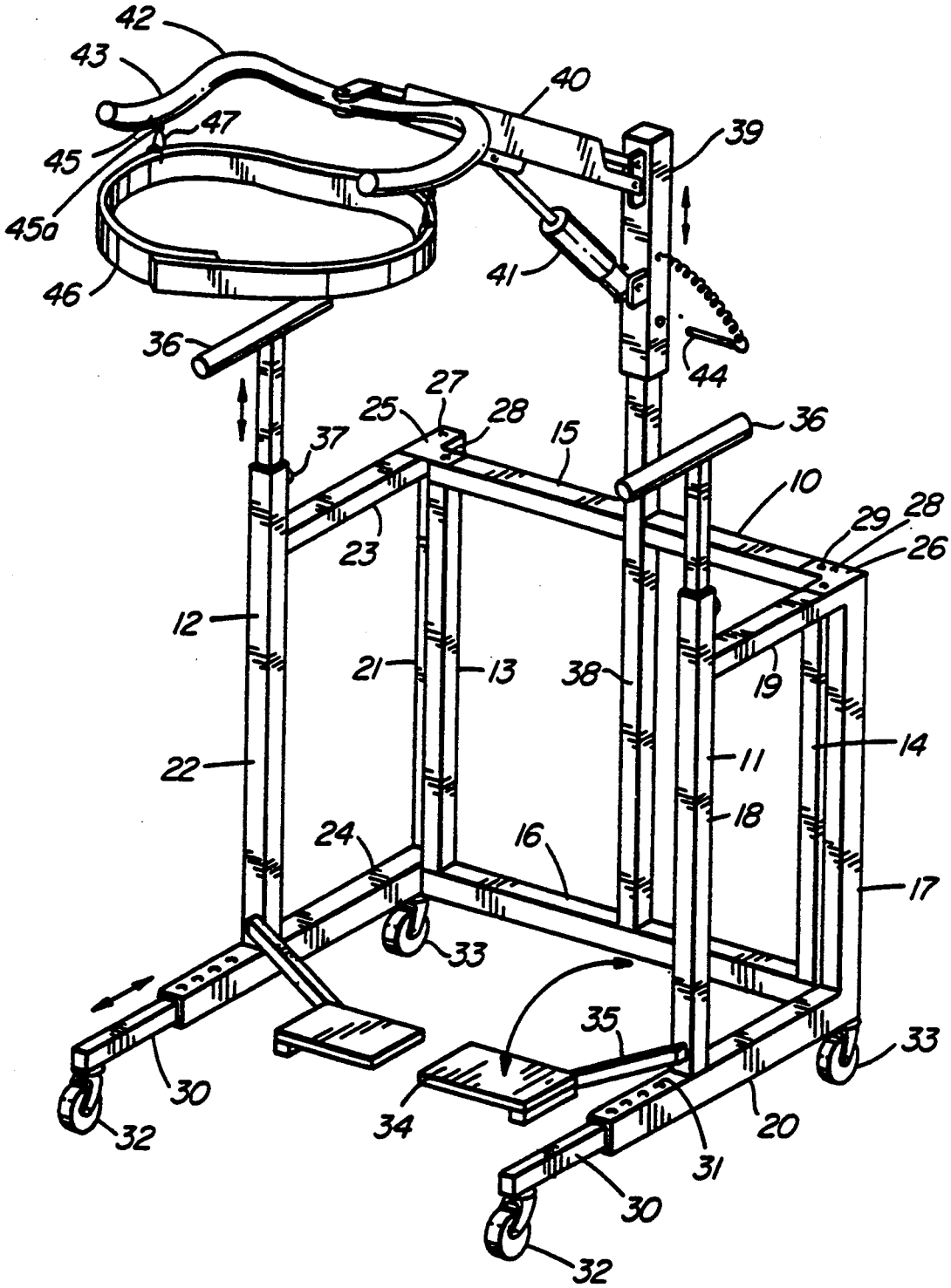
FIG. 1 is a perspective view of a lift in accordance with this invention.
Figure 2:
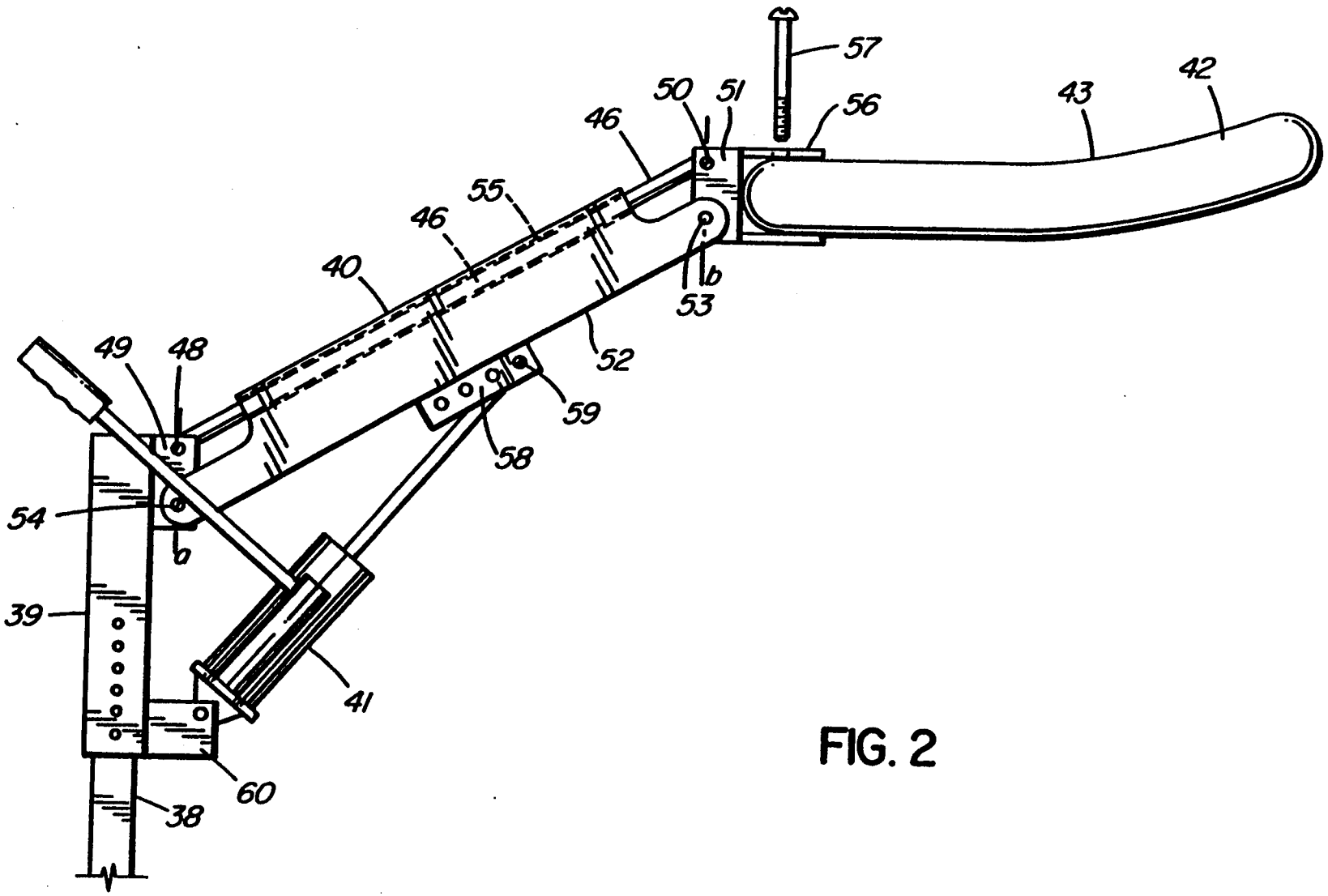
FIG. 2 is a detail view of a lift arm forming part of the lift illustrated in FIG. 1.

Referring now to the embodiment shown in FIGS. 1 and 2 of the drawings, there is illustrated a supporting frame comprising a front portion 10 and side portions 11 and 12. Front portion 10 extends in front of the invalid and side portions 11 and 12 are on each side of the invalid. Front portion 10 comprises upright members 13 and 14, transverse upper member 15 and transverse lower member 16. Side portion 11 comprises upright members 17 and 18, transverse upper member 19 and transverse lower member 20. Side portion 12 similarly comprises upright members 21 and 22, transverse upper member 23 and transverse lower member 24.

Brackets 25 and 26 connect the upper member 15 of front portion 10 to transverse member 23 of side portion 12 and transverse member 19 of side portion 11. Similar brackets (not shown) connect lower transverse member 16 to lower transverse members 20 and 24. Pivot pins 27 and 28 permit side portions 11 and 12 to be folded against front portion 10 once locking pins 28 and 29 have been removed.

Side portions 11 and 12 of the frame each have telescopic extensions 30 adjustably secured by pins 31. Castor wheels 32 are located at the ends of extensions 30. Additional castor wheels 33 are at the intersection of side portions 11 and 12 with front portion 10. Side portions 10 also each have foot rests 34 on arms 35 pivotally connected to upright frame members 18 and 22 so that the footrests can be lowered for the invalid to stand on them or can be raised so as not to interfere with walking.

Adjustable arm rests 36 extend telescopically upward from upright frame members 18 and 22 and are secured by clamping screws 37.

Front frame portion 10 has a central upright member 38 which extends upwardly beyond transverse member 15 to support a mounting 39 for a lift arm 40. Mounting 39 is detachably secured to member 38 by pin 44. A manual hydraulic ram 41 is connected between mounting 39 and lift arm 40 to raise and lower the lift arm, and is within convenient reach of the invalid. A generally U-shaped support member 42 is located at the free end of lift arm 40 and includes supporting bars 43 to fit under the armpits of the invalid. As illustrated, supporting bars 43 are curved to provide a lowered portion 45 for comfort and security. Bars 43 also have connection 45*a* for suspending a harness 46 by links 47.

It is important that bars 43 be maintained parallel to the ground as lift arm 40 is raised and lowered. This is achieved as shown in FIG. 2 by providing lift arm 40 with an upper connecting member or equalizer bar 46 pivotally connected by pin 48 to a bracket 49 on mounting 39 and by pin 50 with bracket 51. Lift arm 40 also includes a lower connecting member 52 pivotally connected to bracket 51 by pin 53 and to bracket 49 by pin 54. Connecting member 52 is shaped, as shown in FIG. 2, to provide a sleeve 55 within which upper connecting member 46 slides.

Bracket 51 has secured to it a channel 56 which receives U-shaped support 42. Securing bolt 57 rigidly connects support member 42 to channel 56. Hydraulic ram 41 is joined to bracket 59 by pin 59 which has several adjustment positions and to bracket 60 which is on mounting 39. A parallelogram is created by upper connecting bar 46, lower connecting bar 52, bracket 49 and bracket 51. This is because pins 48 and 54 are on a line 'a' which is substantially parallel to a line 'b' through pins 50 and 53. Therefore when lift arm 40 is raised or lowered channel 56, and therefore support member 42, always remains substantially parallel to the ground.

Figure 3:
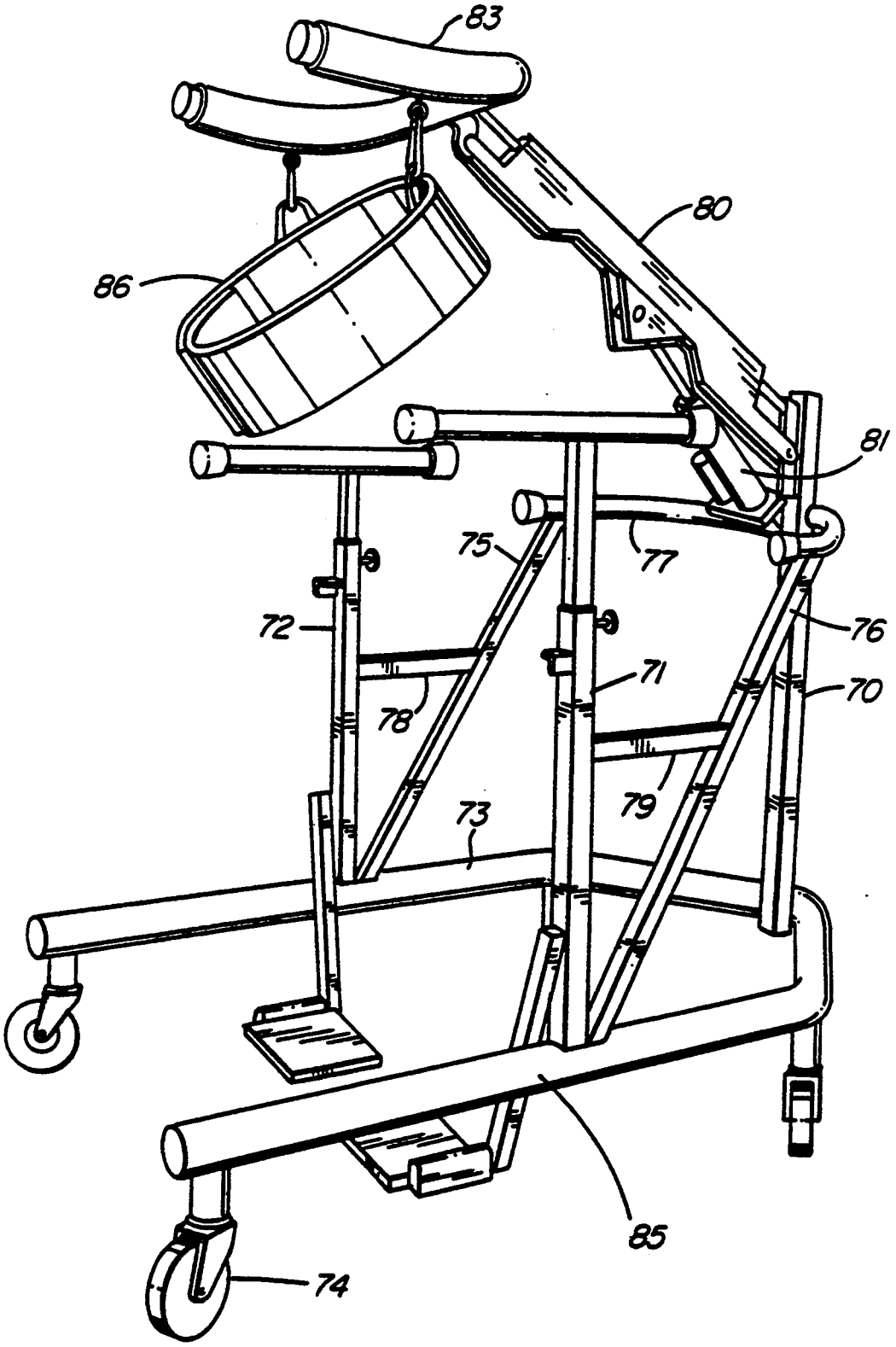
FIG. 3 is a perspective view of a lift in accordance with another embodiment of this invention showing the lift arm raised position.
Figure 4:
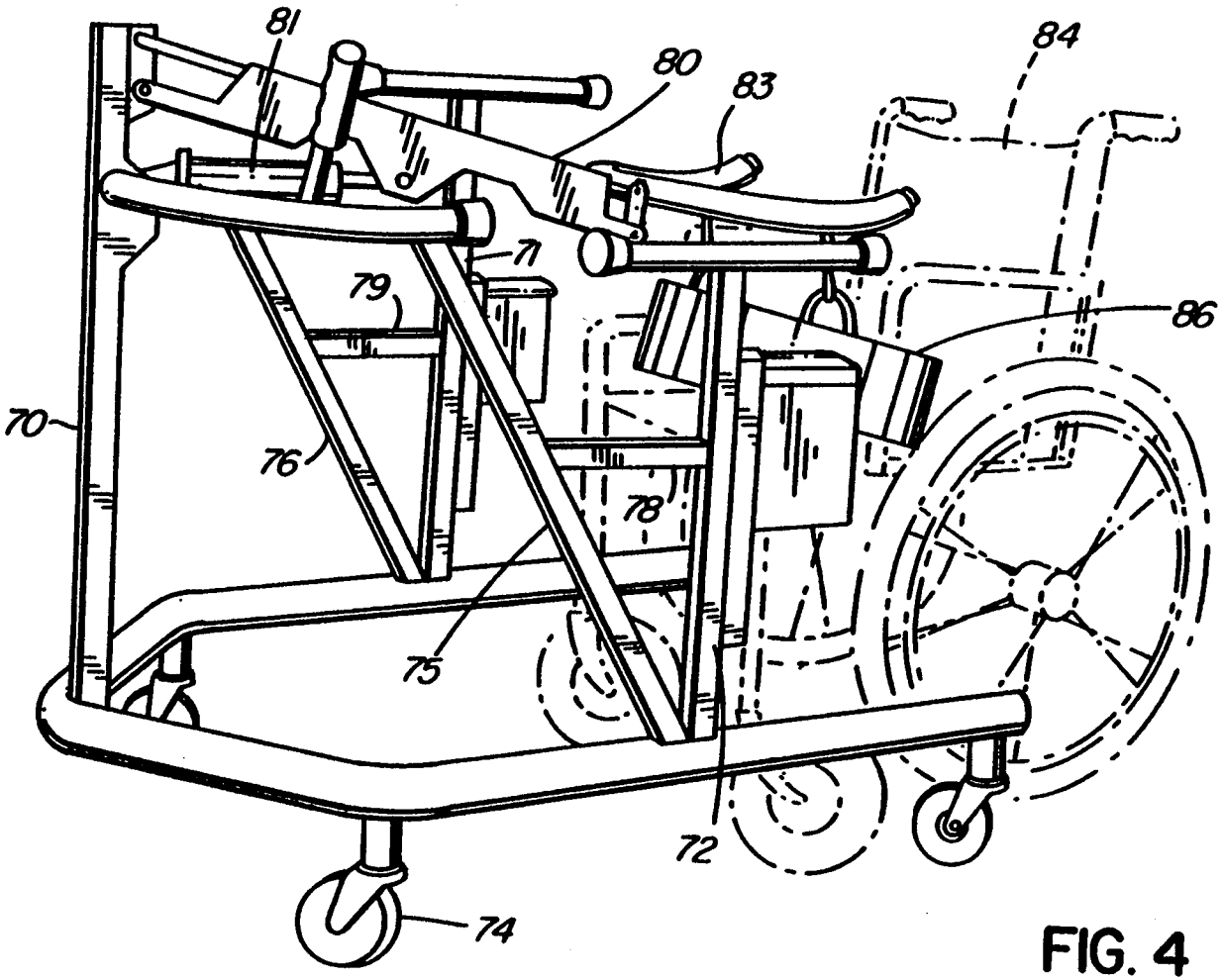
FIG. 4 is a perspective view of the lift illustrated in FIG. 3 but showing the lift arm in lowered position.

FIGS. 3 and 4 illustrate an alternative embodiment which is of heavy duty construction but not as conveniently portable as the lift illustrated in FIGS. 1, 2 and 3.

The frame comprises an upright front member 70 and lateral upright members 71 and 72 mounted on a generally U-shaped horizontal member 73 fitted with castor wheels 74. The frame also includes bracing members 75 and 76 connected to transverse front frame member 77 and transverse side frame members 78 and 79. Lifting arm having a structure similar to that shown in FIG. 2 is pivotally mounted on upright member 70. A hydraulic cylinder 81 raises support member 83 as shown in FIG. 3 or lowers it as shown in FIG. 4 to accommodate a person in wheel chair 84. Foldable leg supports 85 may also be provided. FIGS. 3 and 4 illustrate a harness 86 suspended from support member 83. It is important to note that harness 86 may be in the form of a simple belt to provide auxiliary support and safety. Unlike previous lifts, the belt is not relied on for providing the main support for the patient. Instead the main support is provided by support member 83.

Figure 5:
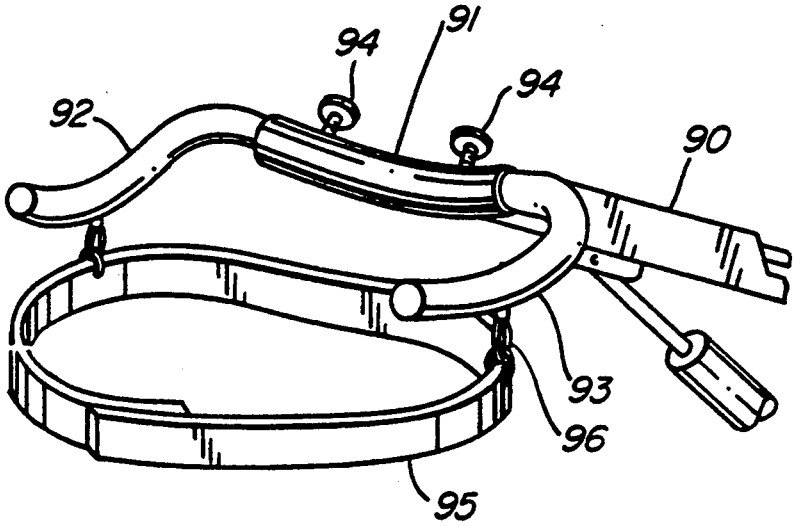
FIG. 5 is a perspective view similar to FIG. 1 but showing part of a lift in accordance with an alternative embodiment of the invention.

In the embodiment of FIG. 5, lift arm 90 supports a sleeve 91 to which support bars 92 and 93 are secured by clamping screws 94. Supporting bars 92 and 93 are similarly shaped to U-shaped support 42 illustrated in FIG. 1. However, clamping screws 94 enable the user to adjust the lateral spacing of bars 92 and 93 to fit comfortably beneath the arm pits of individuals of different width. A harness 95 is suspended from arms 92 and 93 by links 96. The embodiment of FIG. 5 includes means (not shown) to maintain bars 92 and 93 parallel to the ground, similar to that illustrated in FIG. 2.

As a consequence, the lift of this invention is extremely versatile. It can be used to assist persons who have some use of their legs but insufficient strength to give full support to the weight of the body. Leg supports can be used to transport the patient for a distance or for individuals who are unable to use their legs.

I claim:

1. A lift to assist a person to stand comprising a supporting frame having a front portion extending in front of the person and side portions on each side of the person, wheels beneath the supporting frame to enable the lift to be manoeuvered, a rearwardly extending lift arm pivotally mounted at one end on the supporting frame for movement in a vertical plane, a generally U-shaped support member at the other end of the lift arm comprising a pair of supporting bars adapted to fit under the armpits of a person, means for maintaining the U-shaped support substantially parallel to the ground as the lift arm is raised or lowered and means for raising or lowering the lift arm in which the side portions of the frame include arm rests.

2. A lift to assist a person to stand comprising a supporting frame having a front portion extending in front of the person and side portions on each side of the person, wheels beneath the supporting frame to enable the lift to be manoeuvered, a rearwardly extending lift arm pivotally mounted at one end on the supporting frame for movement in a vertical plane, a generally U-shaped support member at the other end of the lift arm comprising a pair of supporting bars adapted to fit under the armpits of a person, means for maintaining the U-shaped suppport substantially parallel to the ground as the lift arm is raised or lowered and means for raising or lowering the lift arm in which foot rests are partially mounted on each side portion of the frame to provide a lowered position in which the person stands on the foot rests and a raised position in which the foot rests do not interfere with the person using the lift as a walker.

3. A lift to assist a person to stand comprising a supporting frame having a front portion extending in front of the person and side portions on each side of the person, wheels beneath the supporting frame to enable the lift to be manoeuvered, a rearwardly extending lift arm pivotally mounted at one end on the supporting frame for movement in a vertical plane generally U-shaped support member at the other end of the lift arm comprising a pair of supporting bars adapted to fit under the armpits of a person, means for maintaining the U-shaped support substantially parallel to the ground as the lift arm is raised or lowered and means for raising or lowering the lift arm in which the side portions of the supporting frame are pivotally connected to the front portion to permit the side portions to be folded against the front portion and releasable locking means for holding the side portions in position for use as a lift.

4. A lift to assist a person to stand comprising a supporting frame having a front portion extending of the person and side portions on each side of the person, wheels beneath the supporting frame to enable the lift to be manoeuvered, a rearwardly extending lift arm pivotally mounted at supporting frame for movement in a vertical plane, a generally U-shaped support member at the other end of the lift arm comprising a pair of supporting bars adapted to fit under the armpits of a person, means for maintaining the U-shaped support substantially parallel to the ground as the lift arm is raised or lowered and means for raising or lowering the lift arm in which the side portions of the supporting frame are pivotally connected to the front portion to permit the side portions to be folded against the front portion and releasable locking means for holding the side portions in position for use as a lift, and in which the lift arm, means for raising and lowering the lift arm and U-shaped support are releasably secured to the frame.

5. A lift to assist a person to stand comprising a supporting frame having a front portion extending in front of the person and side portions on each side of the person, wheels beneath the supporting frame to enable the lift to be manoeuvered a rearwardly extending lift arm pivotally mounted at one end on the supporting frame for movement in a vertical plane, a generally U-shaped support member at the other end of the lift arm comprising a pair of supporting bars adapted to fit under the armpits of a person, means for maintaining the U-shaped support substantially parallel to the ground as the lift arm is raised or lowered and means for raising or lowering the lift arm in which the means for raising and lowering the lift arm is manually actuated and within the reach of a person occupying the lift.

6. A lift to assist a person to stand comprising a supporting frame having a front portion extending in front of the person and side portions on each side of the person, wheels beneath the supporting frame to enable the lift to be manoeuvered, a rearwardly extending lift arm pivotally mounted at one end on the supporting frame for movement in a vertical plane, a generally U-shaped support member at the other end of the lift arm comprising a pair of supporting bars adapted to fit under the armpits of a person, means for maintaining the U-shaped support substantially parallel to the ground as the lift arm is raised or lowered and means for raising or lowering the lift arm in which means are provided for adjusting the lateral spacing of the support frame.

* * * * *